US009249678B2

(12) United States Patent
Simo et al.

(10) Patent No.: US 9,249,678 B2
(45) Date of Patent: Feb. 2, 2016

(54) TRANSITION DUCT FOR A GAS TURBINE

(75) Inventors: John Alfred Simo, Simpsonville, SC (US); Patrick Benedict Melton, Horse Shoe, NC (US); Richard Martin DiCintio, Simpsonville, SC (US); Christopher Paul Willis, Liberty, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 828 days.

(21) Appl. No.: 13/534,744

(22) Filed: Jun. 27, 2012

(65) Prior Publication Data

US 2014/0000265 A1 Jan. 2, 2014

(51) Int. Cl.

| | |
|---|---|
| ***F23R 3/60*** | (2006.01) |
| ***F01D 9/02*** | (2006.01) |
| *F01D 25/28* | (2006.01) |

(52) U.S. Cl.

CPC ..... *F01D 9/023* (2013.01); *F01D 25/28* (2013.01); *F23R 3/60* (2013.01)

(58) Field of Classification Search

CPC ..... F23R 3/002; F23R 3/60; F02C 7/20; F02C 7/28; F01D 9/023; F01D 25/28

USPC ..... 60/752–760, 796, 797, 800

See application file for complete search history.

(56) References Cited

U.S. PATENT DOCUMENTS

| | | | | |
|---|---|---|---|---|
| 4,465,284 | A | 8/1984 | Szema | |
| 5,265,412 | A | 11/1993 | Bagepalli et al. | |
| 5,400,586 | A * | 3/1995 | Bagepalli et al. | 60/800 |
| 5,414,999 | A | 5/1995 | Barnes | |
| 5,749,218 | A * | 5/1998 | Cromer et al. | 60/796 |
| 5,761,898 | A | 6/1998 | Barnes et al. | |
| 6,162,014 | A | 12/2000 | Bagepalli et al. | |
| 6,450,762 | B1 | 9/2002 | Munshi | |
| 6,619,915 | B1 * | 9/2003 | Jorgensen | 415/138 |
| 2003/0039542 | A1 | 2/2003 | Cromer | |
| 2009/0166988 | A1 * | 7/2009 | Irmisch | 277/650 |
| 2010/0061837 | A1 | 3/2010 | Zborovsky et al. | |
| 2010/0242487 | A1 * | 9/2010 | Davis et al. | 60/772 |
| 2012/0047910 | A1 | 3/2012 | Sutcu et al. | |

FOREIGN PATENT DOCUMENTS

| | | | |
|---|---|---|---|
| EP | 1731715 | A1 | 12/2006 |
| EP | 2236760 | A2 | 10/2010 |
| WO | 2007068538 | A1 | 6/2007 |

OTHER PUBLICATIONS

Search Report and Written Opinion from EP Application No. 13172915.4 dated Oct. 30, 2013.

* cited by examiner

*Primary Examiner* — Steven Sutherland
(74) *Attorney, Agent, or Firm* — Dority & Manning, PA

(57) ABSTRACT

A transition duct for a combustor of a gas turbine generally includes a transition duct having a frame at an aft end of the transition duct. The frame generally includes a downstream end, a radially outer portion, a radially inner portion opposed to the radially outer portion, a first side portion between the radially outer and inner portions, and a second side portion opposed to the first side portion. A slot in the first side portion of the frame may have a downstream surface adjacent to the downstream end of the frame. A heat shield having an inner surface, an outer surface and a plurality of spacers may extend generally outward from the heat shield inner surface such that the inner surface is adjacent to the slot downstream surface and the frame downstream end.

17 Claims, 6 Drawing Sheets

TRANSITION DUCT FOR A GAS TURBINE

FIELD OF THE INVENTION

The present invention generally involves a transition duct for a gas turbine. In particular embodiments, the transition duct includes a heat shield that extends at least partially across a downstream end of the transition duct.

BACKGROUND OF THE INVENTION

Turbine systems are widely used in fields such as power generation. For example, a conventional gas turbine system includes a compressor, one or more combustors, and a turbine. In a conventional gas turbine system, compressed air is provided from the compressor to the one or more combustors. The air entering the one or more combustors is mixed with fuel and combusted. Hot gases of combustion flow from each of one or more combustors through a transition duct and into the turbine to drive the gas turbine system and generate power.

In certain combustor designs, a frame may surround an aft end of the transition duct. The frame may generally include a downstream end having an inner portion, an outer portion, and a pair of side portions. The frame downstream end may be positioned adjacent to the turbine. As a result, the frame downstream end may be exposed to extreme thermal stresses caused by the hot gases flowing from the transition duct into the turbine. In particular, as the hot gases flow from adjacent transition ducts, a hot gas recirculation zone may be formed downstream from the transition ducts downstream ends in a volume that extends between the adjacent transition ducts. As a result, a portion of the hot gases flowing into the turbine may be focused on the downstream ends of the adjacent transition ducts frames, causing high temperatures and consequent high thermal stresses.

Current methods to reduce the temperatures and thermal stresses and to enhance the mechanical life of the frame, particularly downstream end of the frame, includes machining cooling passages through the frame downstream end so that a cooling medium such as the compressed air from the compressor may flow through the passages to cool the frame. There is a desire for a transition duct that includes a heat shield to shield at least a portion of the frame downstream end from the hot gases would be useful, since it would reduce frame temperature and thermal stresses and reduce or eliminate the need for machined cooling passages.

BRIEF DESCRIPTION OF THE INVENTION

Aspects and advantages of the invention are set forth below in the following description, or may be obvious from the description, or may be learned through practice of the invention.

One embodiment of the present invention is a transition duct for a gas turbine. The transition duct generally includes a frame at an aft end of the transition duct. The frame generally includes a downstream end, a radially outer portion, a radially inner portion opposed to the radially outer portion, a first side portion between the radially outer and inner portions, and a second side portion opposed to the first side portion. A slot in the first side portion of the frame may have a downstream surface adjacent to the downstream end of the frame. A heat shield having an inner surface, an outer surface and a plurality of spacers that extends generally outward from the heat shield inner surface such that the inner surface is adjacent to the slot downstream surface and the frame downstream face.

Another embodiment of the present invention is a combustor for a gas turbine. The combustor generally includes a transition duct that extends at least partially through the combustor, the transition duct having an aft end and a frame that surrounds the aft end. The frame includes a downstream end, a radially outer portion, a radially inner portion opposed to the radially outer portion, a first side portion between the radially outer and inner portions, and a second side portion opposed to the first side portion. The second side portion also extends between the radially outer and inner portions. A slot in the first side portion of the frame defines a downstream surface adjacent to the downstream end of the frame. A radial seal may be at least partially disposed within the slot. A heat shield may be disposed downstream from the radial seal. The heat shield has an inner surface, an outer surface and a plurality of spacers that extend outward from the inner surface such that the inner surface is adjacent to the slot downstream surface and the frame downstream end.

The present invention may also include a combustor that includes a transition duct that extends at least partially through the combustor. The transition duct may have an aft end and a frame that surrounds the aft end. The frame generally includes a downstream end, a radially outer portion, a radially inner portion opposed to the radially outer portion, a first side portion between the radially outer and inner portions, and a second side portion opposed to the first side portion. The frame second side portion may also extend between the radially outer and inner portions. A slot in the first side portion of the frame includes a downstream surface adjacent to the downstream end of the frame. A heat shield having an inner surface, an outer surface and a plurality of spacers that extend outward from the inner surface may be disposed at least partially within the slot such that the inner surface is generally adjacent to the slot downstream surface and the frame downstream end. A first cooling passage may be generally defined between the heat shield inner surface, the slot downstream surface, the frame first side portion and the frame downstream end.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
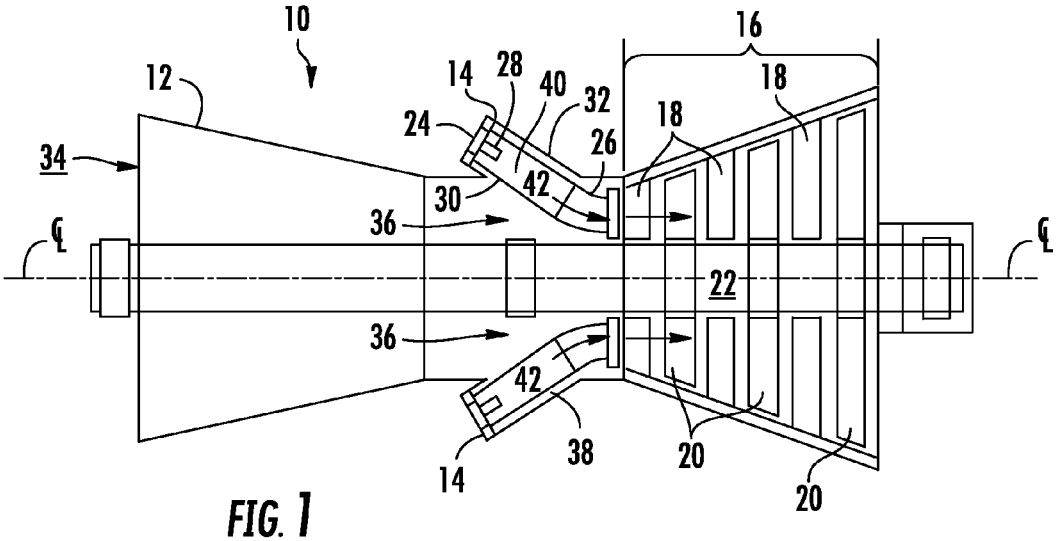
FIG. 1 illustrates a top view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a transition duct for a combustor of a gas turbine. The transition duct generally includes a tubular body having a forward end, an aft end and a frame that at least partially surrounds the aft end. The frame generally includes a downstream end. In particular embodiments, the frame includes a slot that extends through a side portion of the frame, and a heat shield at least partially disposed within the slot. The slot may include a downstream surface that is generally adjacent to the frame downstream end. The heat shield may include an outer surface and an inner surface. The slot inner surface generally contours around a portion of the slot downstream surface, the frame side portion and may be generally adjacent to at least a portion of the frame downstream end. In particular embodiments, a plurality of spacers may extend from the heat shield inner surface towards the frame downstream end, the frame side portion and/or the slot downstream surface, thus allowing a portion of a compressed working fluid to flow between the heat shield and the frame downstream end, thereby reducing thermal stresses on the frame side portion and the downstream end. In addition, the heat shield provides a protective barrier between hot gases of combustion and the frame downstream end, thereby resulting in improved mechanical life of the transition duct. Although exemplary embodiments of the present invention will be described generally in the context of a transition duct incorporated into a combustor of an industrial gas turbine for purposes of illustration, one of ordinary skill in the art will readily appreciate that embodiments of the present invention may be applied to any transition duct and are not limited to an industrial gas turbine combustor unless specifically recited in the claims.

Figure 2:
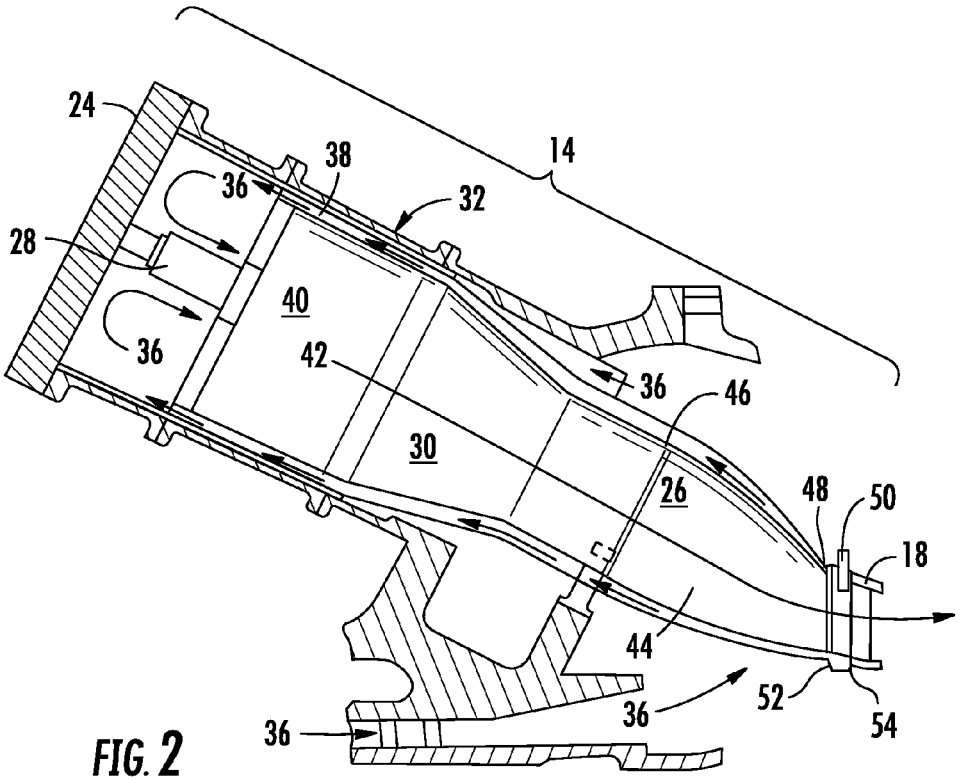
FIG. 2 illustrates a cross section side view of a combustor as shown in FIG. 1.

FIG. 1 provides a schematic of an exemplary gas turbine, and FIG. 2 provides a cross section of a combustor of the gas turbine as shown in FIG. 1. As shown in FIG. 1, a gas turbine 10 generally includes a compressor 12, a plurality of combustors 14 downstream from the compressor 12 and a turbine section 16 downstream from the plurality of combustors 14. The plurality of combustors 14 may be arranged in an annular array about an axial centerline of the gas turbine 10. The turbine section 16 may generally include alternating stages of stationary vanes 18 and rotating blades 20. The rotating blades 20 may be coupled to a shaft 22 that extends through the turbine section 16. As shown in FIGS. 1 and 2, each of the plurality of combustors 14 may include an end cover 24 at one end and a transition duct 26 at the other end. One or more fuel nozzles 28 may extend generally downstream from the end cover 24. A combustion liner 30 may at least partially surround and extend generally downstream from the one or more fuel nozzles 28. The transition duct 26 may extend downstream from the combustion liner 30 and may terminate adjacent to a first stage of the stationary vanes 18. A casing 32 generally surrounds each of the plurality of combustors 14.

In operation, as shown in FIG. 1, a working fluid 34 such as air enters the compressor 12 and, as shown in FIGS. 1 and 2, the working fluid flows into the combustor casing 32 as a compressed working fluid 36. As shown in FIG. 2, a portion of the compressed working fluid 36 flows across the transition duct 26 and through an annular passage 38 at least partially defined between the combustion liner 30 and the casing 32 before reversing direction at the end cover 24. At least some of the portion of the compressed working fluid 36 is mixed with fuel from the one or more fuel nozzles 28 within a combustion chamber 40, as shown in FIGS. 1 and 2, that may be at least partially defined inside the combustion liner 30. The compressed working fluid 36 and fuel mixture is burned to produce a rapidly expanding hot gas 42. The hot gas 42 flows from the combustion liner 30 through the transition duct 26 and into the turbine section 16 where energy from the hot gas 42 is transferred to the various stages of rotating blades 20 attached to the shaft 22, thereby causing the shaft 22 to rotate and produce mechanical work. The remaining portion of the compressed working fluid 36 may be utilized primarily for cooling various components within the plurality of the combustors 14 and the turbine section 16 of the gas turbine 10. Although a reverse flow combustor is disclosed above, it should be obvious to one of ordinary skill in the art that the various embodiments of the present invention may be deployed in any turbo machine and/or gas turbine comprising multiple combustors generally arranged in an annular array.

As shown in FIG. 2, the transition duct 26 may generally include a tubular body 44 having a forward end 46 and an aft end 48 downstream from the forward end 46. The forward end 46 may be generally annular and may be configured to engage with the combustion liner 30. In particular embodiments, as shown in FIG. 2, the transition duct 26 may also include a frame 50 that at least partially circumferentially surrounds the aft end 48 of the tubular body 44. In certain configurations, the frame 50 may be cast and/or machined as an integral part of the tubular body 44 aft end 48. In other configurations, the frame 50 may be a separate component connected to the tubular body 44 aft end 48. For example, but not limiting of, the frame 50 may be connected to the aft end 48 by welding. As shown in FIG. 2, the frame 50 may have an upstream end 52 and a downstream end 54. The frame 50 downstream end 54 may be generally axially separated from the frame 50 upstream end 52.

Figure 3:
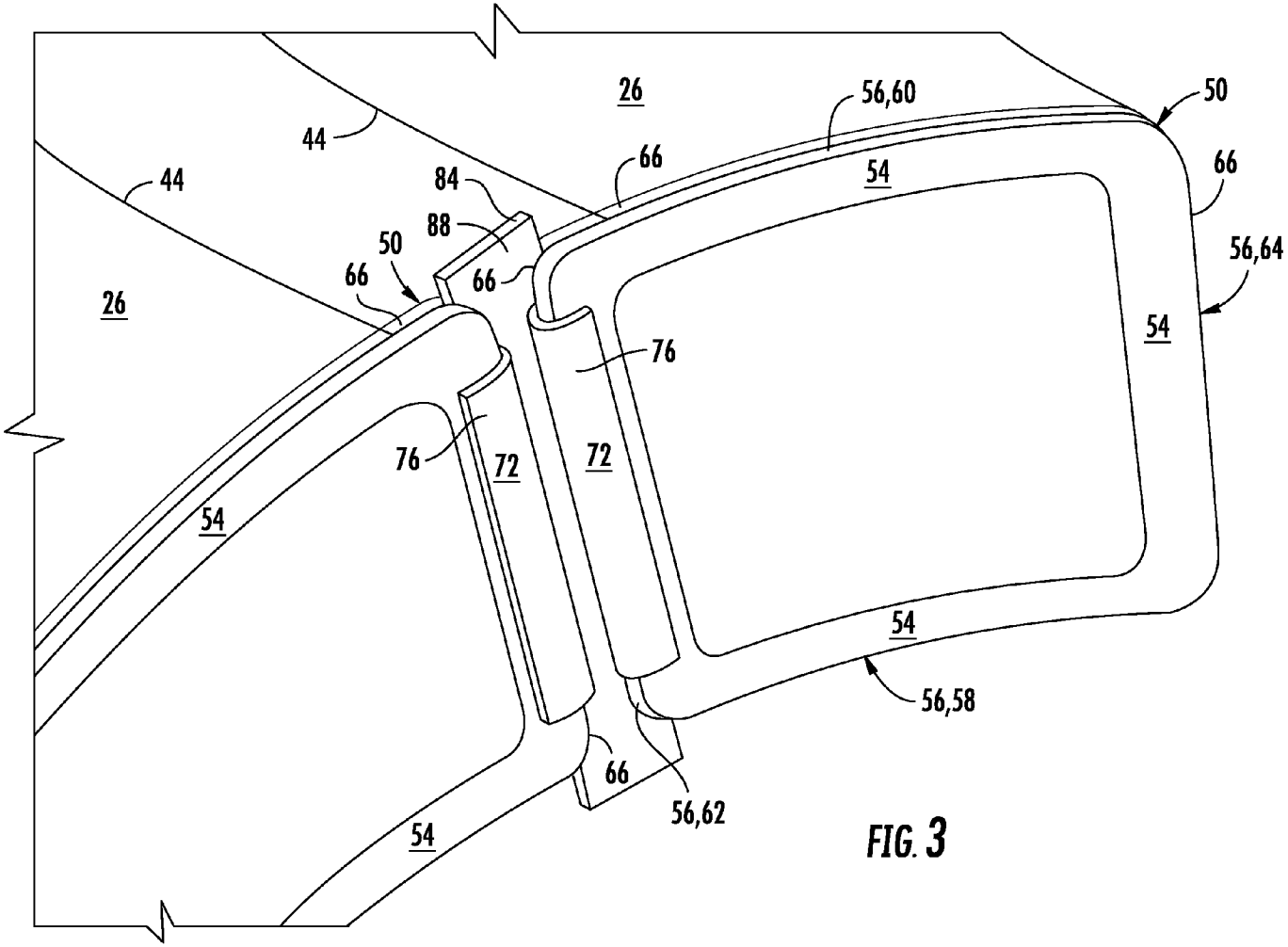
FIG. 3 illustrates an enlarged view of a pair of adjacent transition ducts as shown in FIG. 2, according to various embodiments of the present disclosure.
Figure 4:
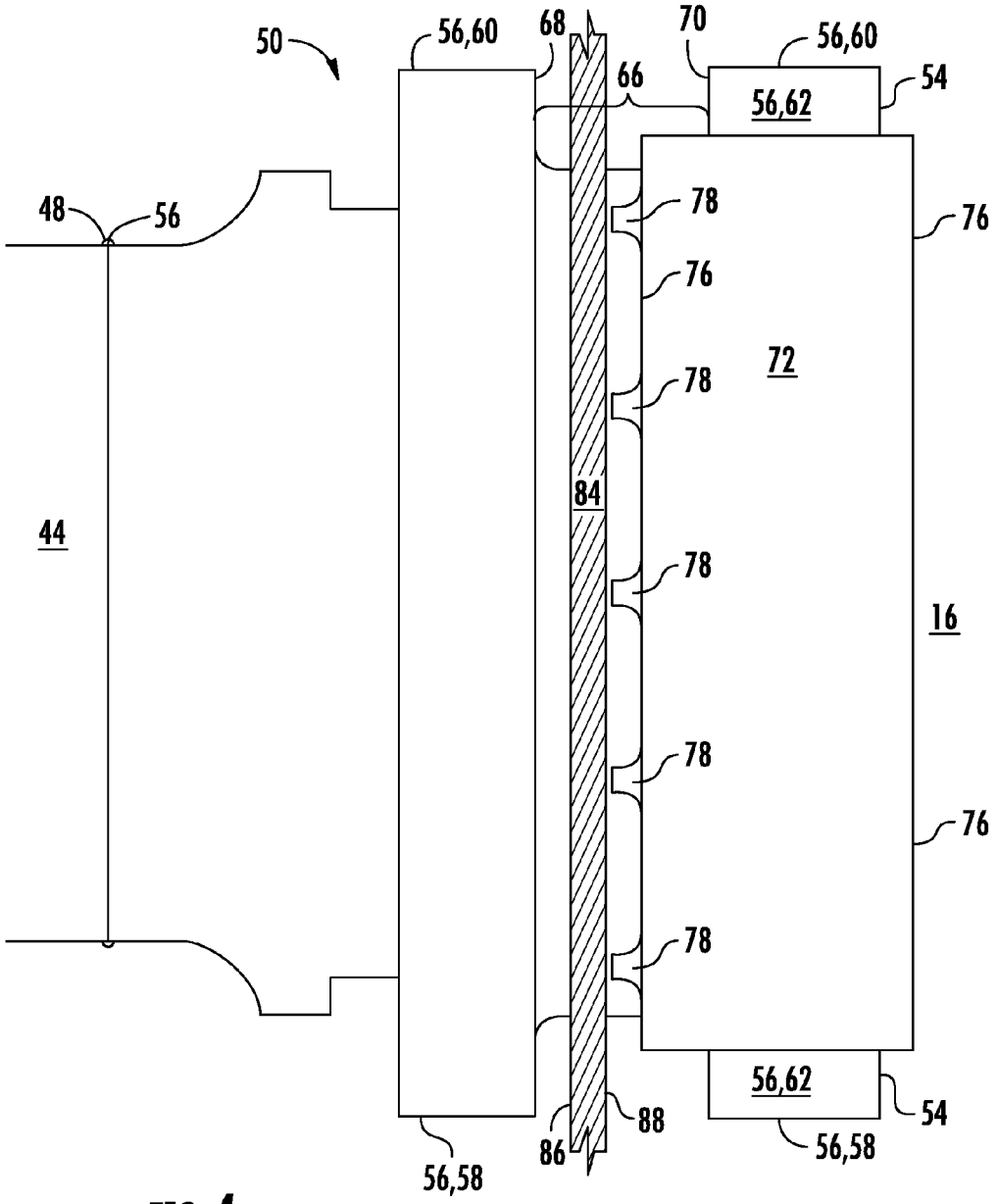
FIG. 4 illustrates a side view of a portion of one of the transition ducts as shown in FIG. 3, according to various embodiments of the present disclosure.
Figure 5:
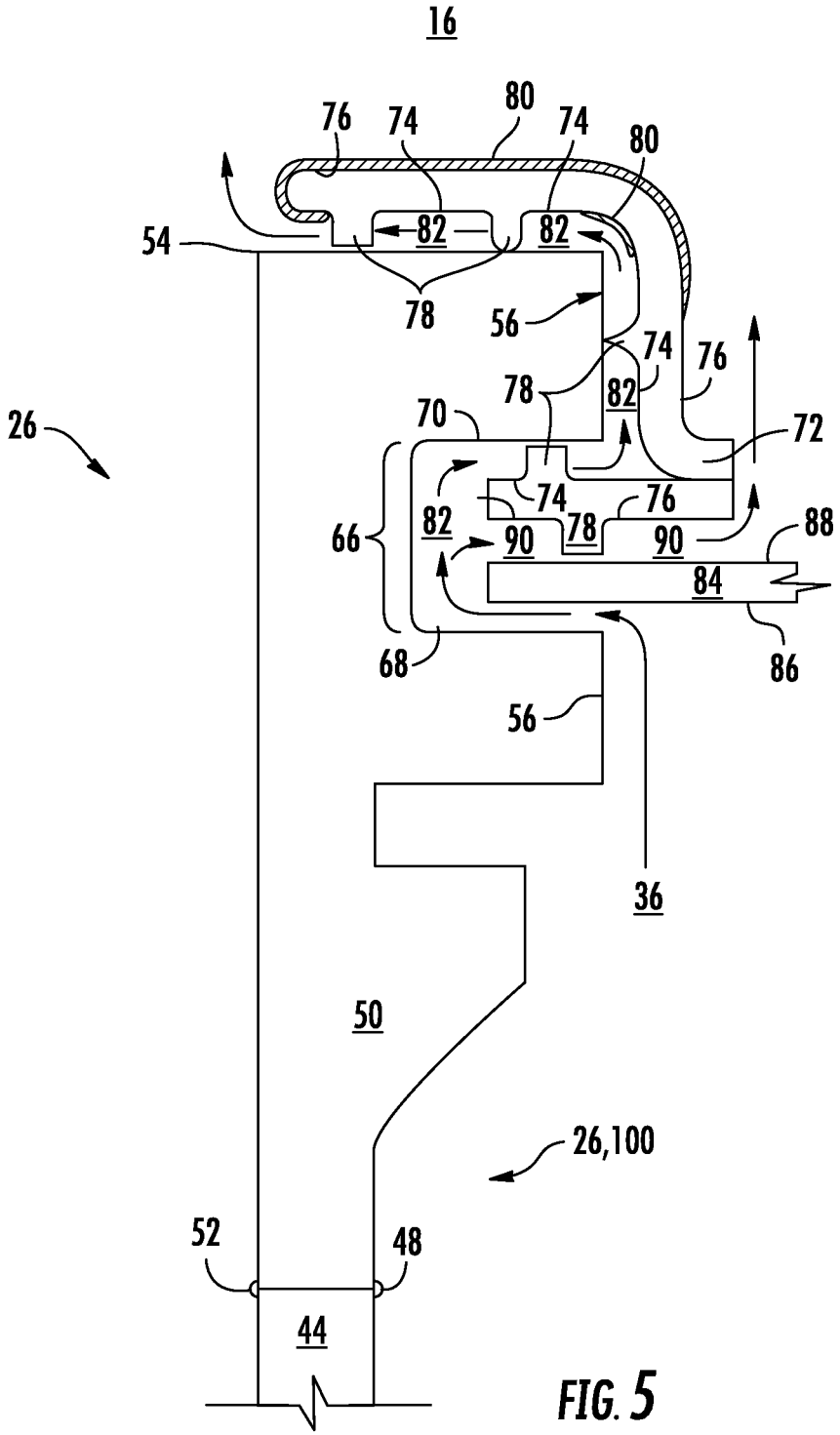
FIG. 5 illustrates a top view of a portion of one of the transition ducts as shown in FIG. 3, according to various embodiments of the present disclosure.

FIG. 3 provides an enlarged view of a pair of adjacent transition ducts 26 as shown in FIG. 2, FIG. 4 provides a side view of one of the transition ducts 26 as shown in FIG. 2, and FIG. 5 provides a top view of a portion of one of the transition ducts as shown in FIG. 3. As shown in FIG. 3, an outer surface 56 may extend at least partially circumferentially around the frame 50. The frame 50 outer surface 56 may extend at least partially between the upstream end 52 and the downstream end 54 of the frame 50, as shown in FIG. 2. As shown in FIG. 3, the outer surface 56 of the frame 50 may extend generally axially upstream from the downstream end 54 of the frame 50. The outer surface 56 of the frame 50 may be apportioned as having a radially inner portion 58, a radially outer portion 60 opposed to the radially inner portion 58, a first side portion 62 between the radially inner and outer portions 58 & 60, and a second side portion 64 opposed to the first side portion 62 and that also extends generally between the radially inner and outer portions 58 & 60.

As shown in FIGS. 3-5, at least one of the outer surface 56 first or second side portions 62, 64 may include a slot 66. As shown in FIGS. 4-5, the slot 66 may be generally "U" shaped so as to define an upstream surface 68 and a downstream surface 70 axially separated from and generally parallel to the upstream surface 68. The slot 66 downstream surface 70 may be generally adjacent and/or perpendicular to the downstream end 54 of the frame 50.

As shown in FIGS. 3-5, a heat shield 72 may be partially disposed within the slot 66. The heat shield 72 may be made of any material sufficient to withstand the thermal and/or mechanical stresses found within the operational environment of the combustor 14. For example, but not limiting of, the heat shield 72 may be made from nickel cobalt chromium alloys. The heat shield 72 may be manufactured using any means known in the art. For example, the heat shield 72 may be stamped, cast and/or machined. The heat shield 72 may be made from one continuous piece of material or may be manufactured from separate materials.

As shown in FIG. 5, the heat shield 72 generally includes an inner surface 74. As shown in FIGS. 4 and 5, the heat shield also includes an outer surface 76. As shown in FIG. 5, a plurality of spacers 78 may extend generally outward from the heat shield 72 inner surface 74. In addition, as shown in FIGS. 4 and 5, the heat shield 72 may further include at least one of the plurality of spacers 78 that extend generally outward from the heat shield 72 outer surface 76. In particular embodiments, as shown in FIG. 5 at least portion of the plurality of spacers 78 may extend from the heat shield 72 inner surface 74 towards at least one of the frame 50 downstream end 54, the slot 66 downstream surface 70 or the first or second side portions 62, 64 of the frame 50. The plurality of spacers 78 may be of any shape, size or arranged in any configuration. For example but not limiting of, as shown in FIG. 5, at least a portion of the plurality of spacers 78 may be generally cylindrical, conical, rectangular, angled or any combination thereof.

In particular embodiments, as shown in FIG. 5, at least a portion of the heat shield 72 may be coated with a heat and/or a wear resistant material 80. For example, but not limiting of, at least a portion the heat shield 72 inner surface 74, the outer surface 76 and/or at least a portion of the plurality of spacers 78 may be coated with the heat and/or the wear resistant material 80. In particular embodiments, the heat and/or wear resistant material 80 may be disposed on a portion of the outer surface 76 of the heat shield 72 that is adjacent to the turbine section 16, thereby providing a protective barrier between the heat shield 72 and the hot gases 42 exiting the transition duct 26. In this manner, thermal and/or mechanical stresses may be reduced on the heat shield 72 outer surface 76, thereby extending the life of the transition duct 26. The heat and/or wear resistant material 80 may be any heat and/or wear resistant material known in the industry designed to withstand the operating environment within the combustor 14.

In various embodiments, as shown in FIGS. 3-5, the heat shield 72 may be at least partially disposed in the slot 66 such that at least a portion of the heat shield 72 inner surface 74 is generally adjacent to the slot 66 downstream surface 70 and another portion of the heat shield 72 inner surface 74 is generally adjacent to the downstream end 54 of the frame 50. In particular embodiments, as shown in FIG. 5, at least a portion of the heat shield 72 spacers 78 may extend between the heat shield 72 inner surface 74 and at least one of the slot 66 downstream surface 70, the frame 50 outer surface 56 first and/or second side portions 62, 64 or the downstream end 54 of the frame 50. In this manner, at least a portion of the plurality of spacers 78 may provide a partial void between the heat shield 72 inner surface 74 and the frame 50, thereby providing a protective barrier between the hot gases 42 flowing from the transition duct 26 into the turbine section 16.

In particular embodiments, the heat shield 72 may be configured so as to compressively engage with the frame 50. For example, the heat shield 72 may be bent or otherwise deformed so as to provide a spring force against the slot 66 downstream surface 70 and the frame 50 downstream end 54, thereby securing the heat shield 72 in place during installation of the transition duct 26 and/or operation of the gas turbine 10.

As shown in FIG. 5, a first cooling flow passage 82 may be at least partially defined between the heat shield 72 inner surface 74 and the frame 50. In particular embodiments, the first cooling flow passage 82 may be defined between the heat shield 72 inner surface 74 and at least one of the slot 66 downstream surface 70, the frame 50 first and/or second side portions 62, 64 or the frame 50 downstream end 54. In this manner, the compressed working fluid 36 may flow from the combustor 14 casing 32 and through the first cooling flow passage 82, thereby providing cooling to the frame 50 and/or the heat shield 72. In addition or in the alternative, the compressed working fluid 36 may provide a positive pressure within the first cooling flow passage 82, thereby impeding the hot gas 42 from flowing upstream between the heat shield 72 inner surface 74 and the frame 50 downstream end 54. As a result, the compressed working fluid 36 flowing through the first cooling flow passage 82 may extend the mechanical performance of the frame and/or the transition duct.

As shown in FIGS. 3-5, a radial seal 84 having a first surface 86 axially separated from a second surface 88 may be at least partially disposed within the slot 66. As shown, the radial seal 84 may generally extend between two slots 66 of two adjacent transition ducts 26 arranged in an annular array about the axial centerline of the gas turbine 10 where each slot 66 is configured as described above. In this manner, the radial seal 84 may reduce and/or control the amount of the compressed working fluid 36 that flows between the two adjacent transition ducts 26 and into the flow of the hot gas 42 passing from the transition duct 26 and into the turbine section 16.

Figure 6:
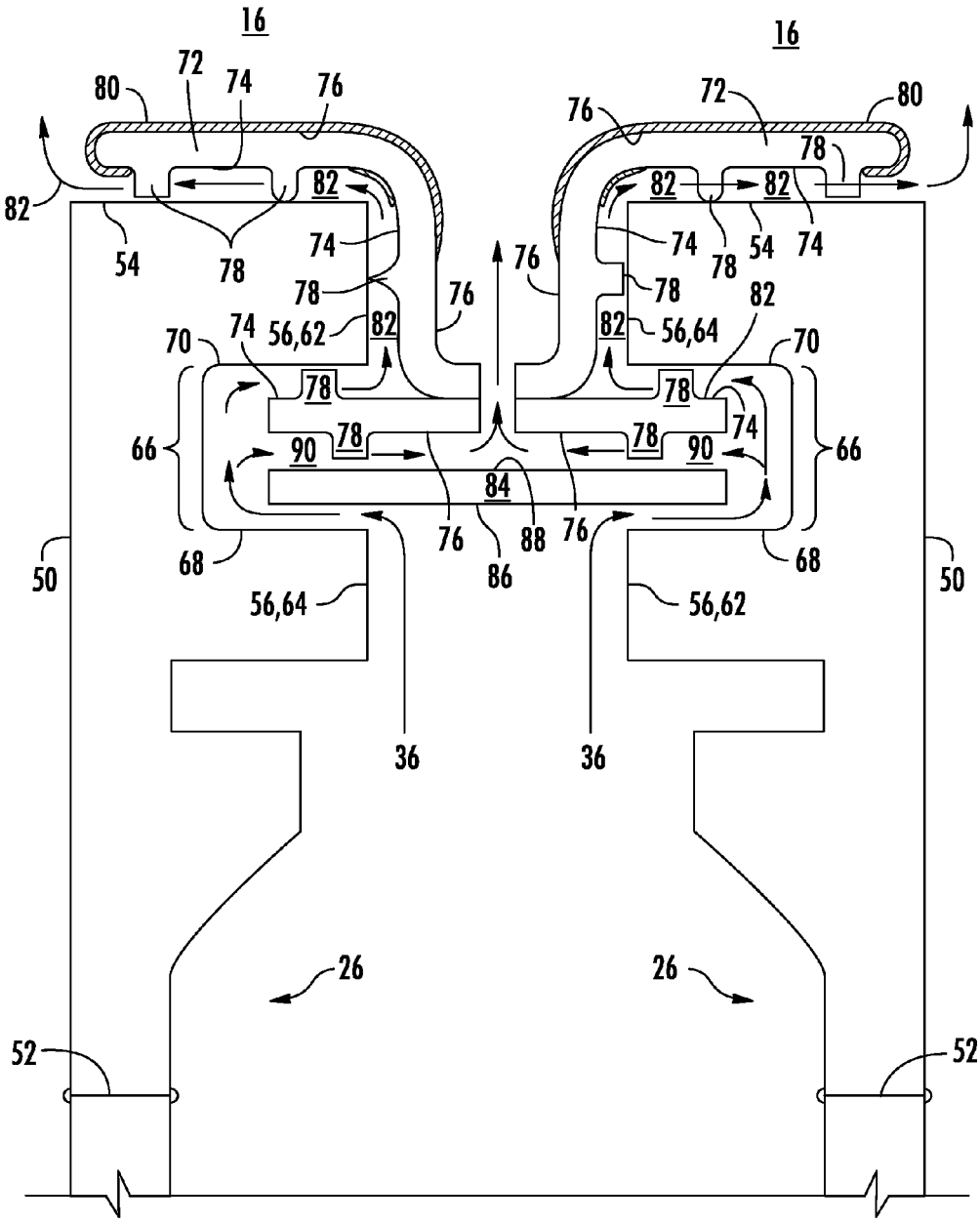
FIG. 6 illustrates a top view of the pair of adjacent transition ducts as shown in FIG. 3, according to various embodiments of the present disclosure.
Figure 7:
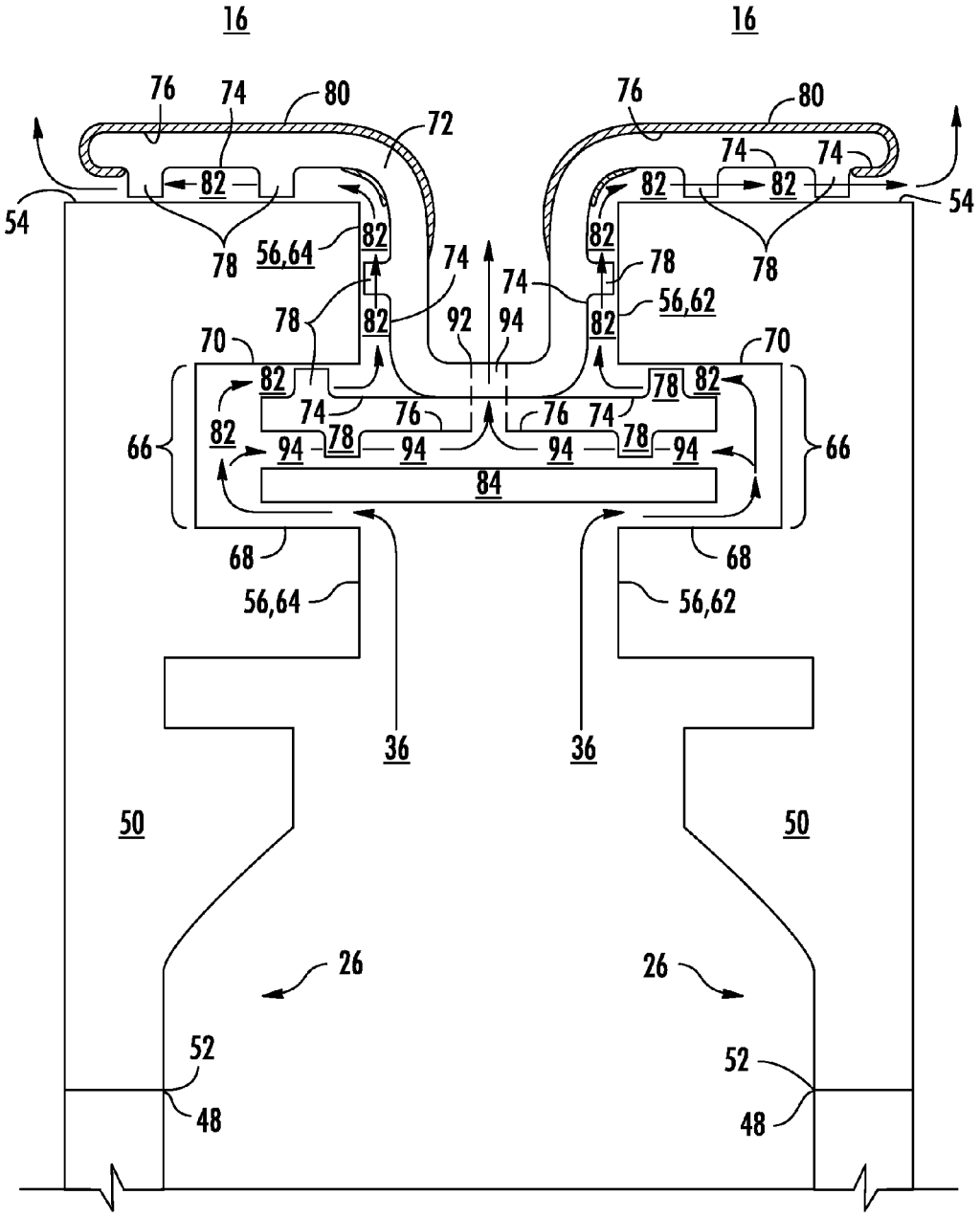
FIG. 7 illustrates a top view of the pair of adjacent transition ducts as shown in FIG. 3, according to various embodiments of the present disclosure.

FIGS. 6 and 7 provide top views of an adjacent pair of the transition ducts as shown in FIG. 3. As shown in FIGS. 3, 6 and 7, the combustor 14 may include one or more of the heat shield 72. In particular embodiments, as shown in FIG. 6, the radial seal 84 may be disposed in the slot 66 of each transition duct 26 generally upstream from the heat shield 72. As shown, each transition duct 26 may include a heat shield 72 configured as previously disclosed. In particular embodiments, the second surface 88 of the radial seal 84 may be generally adjacent to a portion of the outer surface 76 of the heat shield 72. In various embodiments, the one or more spacers 78 that extend outward from a portion of the outer surface 76 of the heat shield 72 may extend between the heat shield 72 outer surface 76 and the radial seal 84 second surface 88. As a result, a second cooling flow passage 90 may be defined between the radial seal 84 second surface 88 and the heat shield 72 outer surface 76. In this manner, a portion of the compressed working fluid 36 may be directed generally between the radial seal 84 second surface 88 and the heat shield 72 outer surface 76. As a result, the amount of the compressed working fluid 36 that flows between the two adjacent transition ducts 26 and into the flow of the hot gas 42 passing into the turbine section 16 may be further controlled and/or reduced, thereby increasing the efficiency of the gas turbine 10. In addition or in the alternative, the compressed working fluid 36 may provide cooling to the radial seal and/or the heat shield 72 outer surface 76, thereby improving the mechanical life of the transition duct 26.

In alternate embodiments, as shown in FIG. 7, the heat shield 72 may extend between the adjacent transition ducts 26. In this configuration, the heat shield 72 is configured to engage contemporaneously with the adjacent frames 50 in the same manner as previously disclosed in the various embodiments above. In addition, the heat shield 72 in this configuration may further include one or more apertures 92 that extend generally axially through the heat shield 72 inner and outer surfaces 74, 76. In this manner, a third cooling passage 94 may be defined between the radial seal 84 second surface 88 (FIG. 6) and the heat shield 72 outer surface 76, and through the plurality of apertures 92. As a result, the compressed working fluid 36 flowing from the combustor 14 casing 32 into the hot gas 42 may be controlled while providing cooling to the heat shield 72, thereby improving turbine efficiency and/or the mechanical life of the transition duct.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A transition duct comprising;

a. a frame at an aft end of the transition duct, the frame having a downstream end, a radially outer portion, a radially inner portion opposed to the radially outer portion, a first side portion between the radially outer and inner portions, and a second side portion opposed to the first side portion between the radially outer and inner portions;

b. a slot in the first side portion of the frame, the slot having a downstream surface adjacent to the downstream end of the frame;

c. a heat shield having an inner surface, an outer surface and a plurality of spacers that extend outward from the inner surface, wherein the inner surface is adjacent to the slot downstream surface and the frame downstream end and wherein the heat shield is configured to exert a compressive force against the slot downstream surface and the frame downstream end; and d. a first cooling passage defined between the heat shield inner surface, the slot downstream surface, the frame side portion and the frame downstream end.

2. The transition duct as in claim 1, wherein at least a portion of the plurality of spacers extend from the heat shield inner surface towards the frame downstream end.

3. The transition duct as in claim 1, wherein at least a portion of the plurality of spacers extend from the heat shield inner surface towards the slot downstream surface.

4. The transition duct as in claim 1, wherein at least a portion of the heat shield inner surface is adjacent to a portion of a frame side surface.

5. The transition duct as in claim 4, wherein at least a portion of the plurality of spacers extend from the heat shield inner surface towards the frame side surface.

6. The transition duct as in claim 1, wherein the heat shield further comprises one or more spacers that extend outward from the heat shield outer surface.

7. The transition duct as in claim 1, wherein at least a portion of the heat shield is coated in at least one of a heat resistant or a wear resistant material.

8. A combustor comprising:

a. a transition duct that extends at least partially through the combustor, the transition duct having an aft end and a frame that surrounds the aft end, the frame having a downstream end, a radially outer portion, a radially inner portion opposed to the radially outer portion, a first side portion between the radially outer and inner portions, and a second side portion opposed to the first side portion between the radially outer and inner portions;

b. a slot in the first side portion of the frame, the slot having a downstream surface adjacent to the downstream end of the frame;

c. a radial seal at least partially disposed within the slot, the radial seal having an upstream surface and a downstream surface, the radial seal at least partially disposed within the slot upstream from a heat shield, wherein the radial seal downstream surface is generally adjacent to a heat shield outer surface;

d. the heat shield disposed downstream from the radial seal, the heat shield having an inner surface, the heat shield outer surface and a plurality of spacers that extend outward from the inner surface, wherein the inner surface is adjacent to the slot downstream surface and the frame downstream end, wherein the heat shield further comprises at least one spacer that extends from the heat shield outer surface towards the radial seal downstream surface;

e. a first cooling passage defined between the heat shield inner surface, the slot downstream surface, the frame side portion and the frame downstream end; and f. a second cooling flow passage at least partially defined between the radial seal downstream surface and the outer surface of the heat shield.

9. The combustor as in claim 8, wherein a portion of the outer surface of the heat shield is adjacent to the radial seal.

10. The combustor as in claim 8, wherein at least a portion of the plurality of spacers extend from the heat shield inner surface towards the downstream end of the frame.

11. The combustor as in claim 8, wherein at least a portion of the plurality of spacers extend from the heat shield inner surface towards the slot downstream surface.

12. The combustor as in claim 8, wherein at least a portion of the heat shield is coated in at least one of a heat resistant or a wear resistant material.

13. A combustor comprising:

a. a transition duct that extends at least partially through the combustor, the transition duct having an aft end and a frame that surrounds the aft end, the frame having a downstream end, a radially outer portion, a radially inner portion opposed to the radially outer portion, a first side portion between the radially outer and inner portions, and a second side portion opposed to the first side portion between the radially outer and inner portions;

b. a slot in the first side portion of the frame, the slot having a downstream surface adjacent to the downstream end of the frame;

c. a heat shield having an inner surface, an outer surface and a plurality of spacers that extend outward from the inner surface, wherein the inner surface is adjacent to the slot downstream surface and the frame downstream end;

d. a first cooling passage defined between the heat shield inner surface, the slot downstream surface, the frame side portion and the frame downstream end; and e. wherein the heat shield is configured to exert a compressive force against the slot downstream surface and the frame downstream end.

14. The combustor as in claim 13, wherein at least a portion of the plurality of spacers extend between the heat shield inner surface and at least one of the downstream end of the frame, the slot downstream surface or the side portion of the frame.

15. The combustor as in claim 13, further comprising a radial seal having an upstream surface and a downstream surface, the radial seal at least partially disposed within the slot upstream from the heat shield, wherein the radial seal downstream surface is generally adjacent to the heat shield outer surface.

16. The combustor as in claim 15, wherein the heat shield further comprises at least one spacer that extends from the heat shield outer surface towards the radial seal downstream surface.

17. The combustor as in claim 16, further comprising a second cooling flow passage at least partially defined between the radial seal downstream surface and the outer surface of the heat shield.

* * * * *